US006688297B1

(12) United States Patent
Clague

(10) Patent No.: US 6,688,297 B1
(45) Date of Patent: Feb. 10, 2004

(54) MAGNETIC ARROW REST BIASING DEVICE

(76) Inventor: Lawrence B. Clague, 370 Park Ranch Pl., Escondido, CA (US) 92025

( * ) Notice: Subject to any disclaimer, the term of this patent is extended or adjusted under 35 U.S.C. 154(b) by 0 days.

(21) Appl. No.: 10/262,760

(22) Filed: Oct. 1, 2002

(51) Int. Cl.[7] ..... F41B 5/22
(52) U.S. Cl. ..... 124/44.5
(58) Field of Search ..... 124/44.5, 24.1

(56) References Cited

U.S. PATENT DOCUMENTS

| | | | | |
|---|---|---|---|---|
| 3,342,173 A | | 9/1967 | Ferguson | |
| 4,343,286 A | | 8/1982 | Thacker | |
| 4,473,058 A | | 9/1984 | Terry | |
| 4,489,704 A | | 12/1984 | Troncoso, Jr. | |
| 4,548,189 A | | 10/1985 | Pietraszek et al. | |
| 4,860,719 A | | 8/1989 | Scheiterlein | |
| 5,490,491 A | * | 2/1996 | Troncoso | |
| 5,503,136 A | | 4/1996 | Tone | |
| 5,535,728 A | * | 7/1996 | Prodigo | 124/44.5 |
| 5,601,069 A | | 2/1997 | Clark | |
| 5,606,961 A | * | 3/1997 | Basik et al. | 124/44.5 |
| 5,606,962 A | | 3/1997 | Troncoso | |
| 5,722,381 A | * | 3/1998 | Mizek | 124/44.5 |
| 6,021,769 A | * | 2/2000 | Troncoso | 124/44.5 |
| 6,082,348 A | | 7/2000 | Savage | |
| 6,561,174 B1 | * | 5/2003 | Afshari | 124/44.5 |
| 6,595,195 B1 | * | 7/2003 | Barner et al. | 124/44.5 |

* cited by examiner

*Primary Examiner*—John A. Ricci
(74) *Attorney, Agent, or Firm*—Donn K. Harms

(57) ABSTRACT

An improved archery arrow rest that holds an arrow in a ready-to-fire position using a biasing mechanism with magnetic attraction on communicating force to the components while not being in direct contact. When the arrow is released by the archer, the flexing of the arrow creates a force on the arrow support which is communicated to a rotating pivot providing enough force to break the magnetic attraction between the a pivot mounted leaf member and a magnet, thus allowing a biasing spring or a secondary magnet to rotate the arrow support down and out of the way of the arrow shaft and fletching or vanes attached thereto. By fine-tuning the gap between the magnet and the leaf member, the force of rearward bias and reaction time of the device can be cut down to react to even the fastest of bows.

15 Claims, 2 Drawing Sheets

MAGNETIC ARROW REST BIASING DEVICE

FIELD OF THE INVENTION

This invention relates to the field of archery. More particularly, it relates to arrow rest devices involved in accurate shooting of the new, faster, and more powerful bows of today. Archers may participate in several forms of shooting. The two most popular activities, bow hunting and target shooting, are greatly improved by arrow rests which provide little or no interference with an arrow being shot by the bow.

BACKGROUND OF THE INVENTION

Bows and arrows rank among man's oldest weapons, with the prehistoric man shooting game for their subsistence. Many types of bows were developed, including the short bow, English longbow, and the cross bow that came about in the middle ages. More recent has been the development of the compound bow that has greatly advanced the field archery. Every year between 1,500,000 and 4,000,000 people in Canada and the United States go bow hunting or take part in some form of archery competition. The sport has become especially popular in schools and colleges. The summer Olympic games included an archery competition from 1896 until the sport was dropped following the 1920 games. Archery was reintroduced in the 1972 summer Olympic games and still remains very popular today.

The two most popular archery activities are bow hunting and target shooting. In bow hunting, the archers hunt game with just the bow and arrow. Bow season usually precedes the regular hunting season, giving the archers some distinct advantages.

In target shooting, the archer shoots at a target to score points in competition with other archers. When an archer prepares to shoot, the arrow shaft is conventionally positioned on an arrow rest of some kind, the bowstring is set within the arrow nock, and the bowstring and arrow are drawn back. The archer aims through the area above the rest and beside the bow riser section called the window region. After the arrow is released and it passes by the position of the rest, a common occurrence is for the fletches or plastic vanes to strike the rest moving it out of the way. This causes the arrow to be deflected and wobble in flight. Very light weight carbon graphite arrows are often used adding to the problem when such arrows are deflected, even in the slightest.

For the avid archer that is striving for perfection this deflection by the rest during traverse of the arrow is a major problem and can only be resolved by some form of retracting arrow rest which moves to avoid contact with the moving arrow. Other rests incorporate a stationary or flexible element that the arrow is held against and these devices also have an undesirable effect on the flight of the arrow.

Various other types of drop away rests have been previously created. All share a feature that allow the arrow support arm to move out of the path of the arrow shaft and fletching when the arrow is released by the archer. Some of the other current designs depend on the arrow support arm to be pulled into the upright position when the bow is drawn, and to spring back out of the way when the arrow is released. This is accomplished by a physical connection from the arrow rest to either the cable slide or cable of a compound bow. The physical connection is in the form of a string, rubber tubing, or other similar item. There are a number of problems with this system of lifting the arrow supports arms. Strings can snag on branches while in the field or restrict the length the arrow can be drawn back, the rubber tubing can crack from exposure to UV light or break without warning, all can cause maladjustment or failure of the system.

The disclosed device herein generally relates to a device for improving the accuracy and refining the arrow rests for either bows or crossbows. More specifically, it relates to an improved magnetic drop-away arrow rest retro-fit conversion kit to be attached to the crossbar support block or which can be manufactured and attached to the support block at the factory as original equipment. The reason for the drop-away rest is to support the arrow, then to move completely away upon release before the fletches or vanes pass over the rest so they will not be damaged or the accuracy of the arrows flight affected.

U.S. Pat. No. 3,342,173 of Eugene L. Ferguson describes an arrow rest that is magnetically held in a position to support the arrow prior to being released. Upon release of the arrow, as the fletches or vanes pass the supporting means they will strike it, causing the release of the magnet and the supporting means will pivot to the side against the bow riser, out of the way to be manually reset. The action of the feathers or vanes striking anything, and the rest passing under the arrow, has the tendency to cause the arrow to wobble, affecting the accuracy of the shot.

U.S. Pat. No. 4,343,286 of Bobby J. Thacker teaches of a bow, the center of which is constructed to permit an unimpeded, dead center flight of the arrow as it leaves the bow. This unique, unconventional bow and arrow has a cumbersome magnetic system with a special magnetically attracted point or pile for retracting the arrow rest out of the way as the arrow passes. This device would be difficult to adapt to any conventional bow and would require the archers to purchase special bows and arrows.

U.S. Pat. No. 4,473,058 of Edgell R. Terry discloses a bow and arrow rest, which includes a wire that is pivotally mounted near the middle of the bow. The wire is held in, place by a magnet that supports the arrow against a fixed support. When the arrow is released and the rest pivots under the arrow and out of the way against the bow riser, the support remains in a fixed position against the arrow. There is also no adjustment to the magnetic contact on the wire rest for arrows of different diameters or to fine tune the release mechanism.

U.S. Pat. No. 4,489,704 of Fernando Troncoso additionally describes an arrow rest that is spring or magnetically loaded to hold the arrow with a curve in the end of a wire support member against an adjustable plunger. Although all portions of this device are fully adjustable, when the device is set up and the arrow is released, the arrow still rides against the plunger as it passes the rest and the wire rest pivots under the arrow to the side against the riser.

U.S. Pat. No. 4,548,189 of Mitchell E. Pietraszek describes a ferromagnetic wire rest member that is pivotally attached to a mounting bracket and is biased into operative position. A permanent magnet permits the rest pin to be deflected from the operative position by the fletches of an arrow passing across the rest pin. This is another device that allows the rest to engage the fletches causing a wobble of the arrow during flight and affecting the accuracy of the shot.

U.S. Pat. No. 4,860,719 of Ernst Scheiterlein teaches of a hold down device for a crossbow arrow or bolt using a magnetic support and adjustably positionable in the tray beneath the ferro-magnetic arrowhead to hold the arrow against the arrow rest. This device is designed specifically for crossbows and has adjustment of the spacing of the magnet away from the arrowhead, but it does not describe any unique features in the rest for the arrow and would not function on a conventional bow.

U.S. Pat. No. 5,503,136 of Richard D. Tone discloses an invention that relates to an arrow support mechanism including an arrow rest arm that is magnetically, weight, or spring-biased inward toward the side of the bow window so as to retract out of the path of a vane of the arrow just after it is released. With this patent, a rest arm that is slightly curved upward retains the arrow against an elastic "spine point" arm. Upon release, the curved end has to pass under the arrow to be retracted against the side of the bow riser section while still being held against the elastic "spine point" arm, both of which have adverse effects on the flight of the arrow.

U.S. Pat. No. 5,601,069 of James F. Clark teaches of an arrow rest consisting of an articulated or telescoping pin having a spring-loaded retract mechanism to the side against the bow riser. This sideways movement of the arrow rest has a noticeable adverse effect on the flight of the arrow.

U.S. Pat. No. 5,606,961 of Ronald Basik describes an arrow rest that relies upon the friction of the arrow against the pivoting body member when the arrow is propelled by the bowstring. This arrow rest pivots down and out of the way, in the direction of the travel of the arrow flight, and it uses a rubber band or spring biasing over-center action as a release means with the option of using two attracting magnets in direct contact to hold the mechanism open or closed. With the magnets held in direct contact there is no means to fine-tune the release capabilities of the device. This device also cannot be used as a conversion kit for any other manufacturer's arrow rest assemblies.

U.S. Pat. No. 5,606,962 of Vincent Troncoso discloses an arrow rest that also rotates down forward and out of the way when the archer releases an arrow. This patent deals strongly with the horseshoe style of support arms and their unique capabilities, but it does not have a means to fine-tune the release mechanism.

U.S. Pat. No. 6,082,348 of Huey P. Savage tells of an arrow shaft support that pivots away from the arrow shaft with sufficient speed to prevent any of the arrow vanes from striking any of the arrow shaft supports. This system also drops away in front of the path of the arrow and has an adjustable tension on a biasing spring, but has the magnet in contact in the cocked position, and is not adaptable as a conversion kit for any other manufacturers arrow rest assemblies. Another flaw is that the length of the magnetic contact arm is so long that when the rest operates there can be contact with the archers thumb in some bow configurations.

Existing drop away rests that hold the arrow support in the upright position with magnetic force, as in U.S. Pat. No. 6,082,348 (Savage), also suffer from various design impediments. Among the flaws of this design is a long heavy magnetic contact arm. The arrow support arm must pivot out of the path of the shaft and arrow fletching. The inertial mass caused by the weight and length of the magnetic contact arm in the existing design causes the pivot action to be slow, thus, with extremely fast bows, the rest support arms will not drop in time to clear the fletching. This design calls for direct physical contact between the magnet and the magnetic contact arm, effectively eliminating any adjustment of the magnet force required to break said contact. This is an extremely limiting feature of the current design, as there is no adjustment for differences in arrow shaft or point weights. Additionally, the magnetic contact arm is designed to function on either a right or a left handed rest but not both. Another problem is that the length of the magnetic contact arm is so long that when the rest operates there can be contact with the archers thumb in some bow configurations, contact when an archer has a large hand, or contact when the archer is wearing a glove. Any contact can prevent the rest support arms from dropping consistently and ruining arrow accuracy.

The improved archery arrow rest of this invention provides remedies for the faults found in previous designs. By using a magnetic attraction to hold the arrow support arms in a ready position, strings or tubing that pull the arrow support arms into position are eliminated; consistency and repeatability in the positioning of the arrow support arms is achieved, improving accuracy. By utilizing magnetic attraction without actual contact, the force required to cause the biasing spring to function is reduced and the drop away action is more consistent. By utilizing a very small magnetic attraction arm that does not actually come in contact with the magnet, the speed with which the arrow support arms can move out of the path of the arrow shaft and attached fletching is increased because there is less inertial mass to overcome. By positioning the magnet on the crossbar support block and the magnetic attraction arm on the arrow support block, possible contact with the archer's thumb, hand, or glove is totally eliminated. Additionally, the rest can be micro adjustable in both vertical and horizontal directions without affecting the orientation of the arrow support arms or the magnetic attraction arm. The magnet holder is movable in the vertical plane, thus making adjustments for magnet holding force and arrow weight simple.

None of the foregoing prior art teaches or suggests the particular combination of a first or forward biasing means such as a biasing spring, and a rearward biasing means in the form of a single magnet attracting a steel leaf and not rebuking direct contact with a steel leaf member, or, the combination of two magnets at opposite ends of the rotation, one out of direct contact when the device is in the cocked position and the other in direct contact with an adjusting screw in the released position. The biasing force to separate two magnets in direct contact can only be changed by changing the type or size of the magnets, while by maintaining a gap between, the magnets adjustments can easily be made. Thus, there is a continuing need to refine and develop new and innovative products in the field of archery.

SUMMARY OF THE INVENTION

A first preferred embodiment of the herein disclosed magnetic biased drop-away arrow rest device would be in the form of a conversion kit consisting of a number of parts that convert a conventional arrow rest into a unique magnetically biased and actuated drop-away arrow rest. These parts consist of a support-mounting block that attaches to a pivoting unit of the conventional arrow support using two mounting screws. A third screw attaches the arrow rest that can be made from a plastic material or metal. A locking screw locates the pivoting unit on a pivot shaft incorporating the biasing spring and the biasing spring adjustment knob. The biasing spring adjustment knob is held in place on the cross bar support by the means of a locking screw. The pivoting unit also incorporates the steel leaf member attached by the means of the pivot positioning screw and lock nut. The magnet support block is attached to the distal end of the cross bar support by the means of a mounting screw and registered in location by the two adjacent mating surfaces.

As the pivoting unit rotates with the pivot shaft within the cross bar support, the steel or similar magnetically attractive leaf member attached thereto comes within close proximity to the magnet on the magnet support block but does not contact the magnet, thereby maintaining a controlled gap with the magnetic attraction between the magnet and leaf member. The spacing or gap between the magnet and the steel leaf member, and the resulting amount of force of the magnetic bias, is maintained by adjusting the pivot adjustment screw against a stop located on the arm of the cross bar support. The adjustment of this spacing or gap between the magnet and the steel leaf member holding the device in the cocked position and the biasing spring pressure to release the mechanism into the drop-down position, provides a means to adjust the biasing force of the magnetic attraction overcoming the spring bias and the speed of release of the mechanism to thereby rotate quicker than if the magnet was in full contact with the steel leaf member. The thin cross sectional area of the steel leaf member allows some flexibility when reacting with the magnetic attraction of the magnet.

An alternate preferred embodiment of the device will feature a magnetic drop-away arrow rest conversion kit with dual magnet attraction, having a second magnet on the same magnet support block. As with the first preferred embodiment, the conversion kit operates with the pivoting unit rotating with the pivot shaft within the cross bar support, and the steel leaf member coming within close proximity to the magnet on the magnet support block, but not contacting the magnet. The spacing or gap between the magnet and the steel leaf member is maintained by adjusting the pivot adjustment screw against a stop located on the arm of the cross bar support as in the first embodiment. The adjustment of this spacing or gap between the magnet and the steel leaf member holding the device in the cocked position is counter acted by a second magnet attracted to the head of a steel adjusting screw drawing the device to the release position. The biasing spring used in the first embodiment will not be required in the second embodiment. Positioning of the adjustment screws and the strength of the magnets has the capability of vastly reducing the reaction time of the conventional arrow rest.

An additional preferred embodiment of the device will consist of a support-mounting block as an integral part of the pivoting unit with a screw attaching the arrow rest to be made from a plastic material or metal. This would allow the device to be made in one unit at the factory as original equipment. A locking screw locates the pivoting unit on the pivot shaft incorporating the biasing spring and the biasing spring adjustment knob. The biasing spring adjustment knob is held in place on the cross bar support by means of a locking screw on the first embodiment but not required on the second embodiment. The pivoting unit also incorporates the steel leaf member attached by the pivot positioning screw and lock nut. The end of the cross bar support mechanism will incorporate either the single magnet section of the first embodiment or the dual magnet sections of the second embodiment. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

An object of this invention is to create an arrow rest that drops down out of the way, in line with the direction of the flight of the arrow.

Another object of this invention is to create an arrow rest that drops down out of the way, without adversely affecting the flight of the arrow in any way.

Yet another object of this invention is to increase the speed with which the rest drops down.

A further object of this invention is to create an adjustment means between a spring and a magnetic force or two magnetic forces to create the quickest reaction time possible.

An additional object of this invention is to create a dependable arrow rest with repeatable performance.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figures 1, 2, 3:
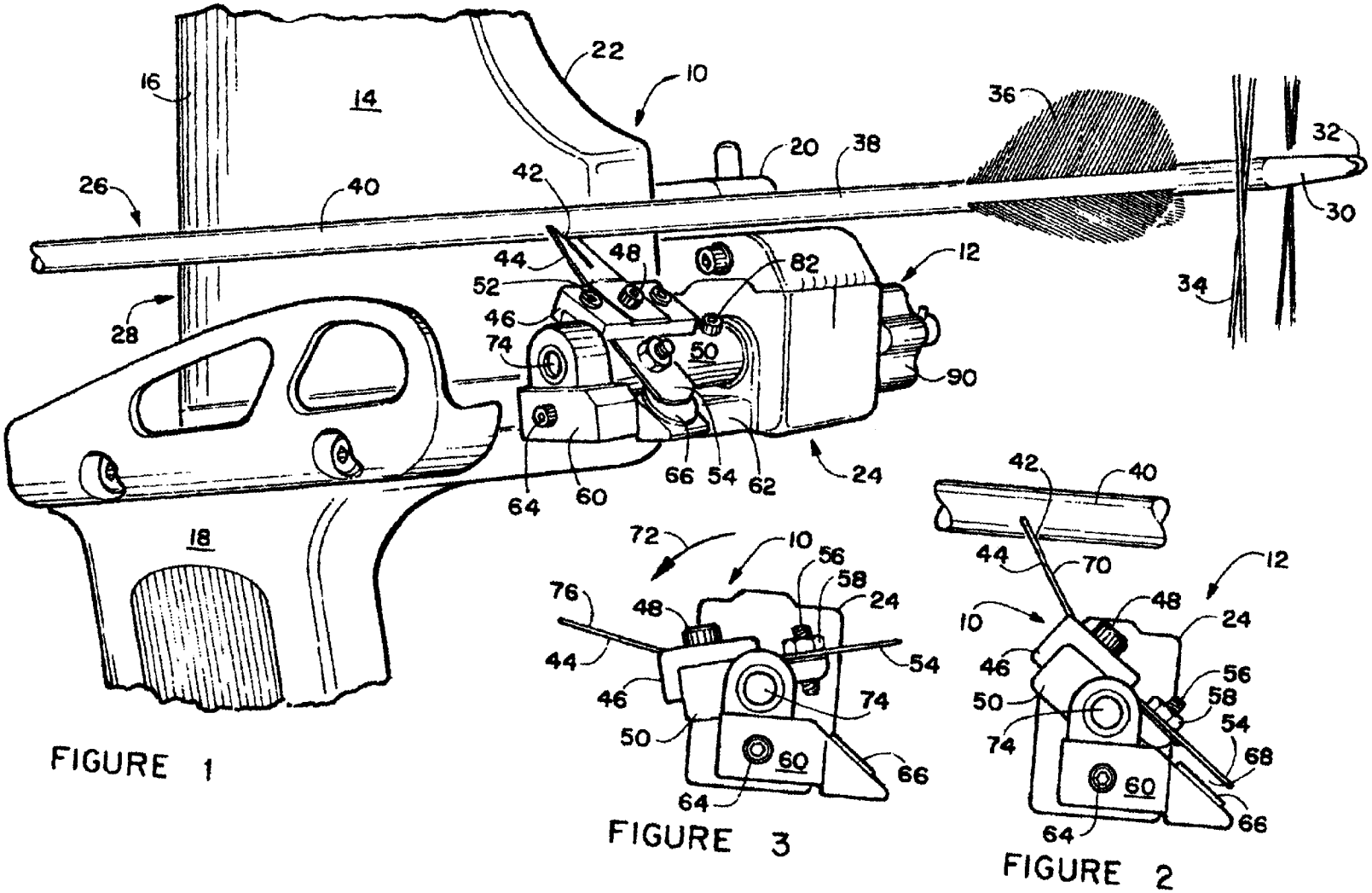
FIG. 1 depicts a perspective view of the central riser section of a bow with the magnetic drop-away arrow rest conversion kit attached to a conventional arrow rest.
FIG. 2 depicts an end view of the magnetic drop-away arrow rest conversion kit attached to a conventional arrow rest in the cocked position.
FIG. 3 depicts an end view of the magnetic drop-away arrow rest conversion kit attached to a conventional arrow rest in the released position.

Referring now to the drawings, wherein similar parts of the invention are identified by like reference numerals, there is seen in FIG. 1 the magnetic drop-away arrow rest conversion kit assembly 10 attached to a conventional arrow rest 12 at the bow riser section 14 of the bow 16 above the hand grip 18. The mounting section 20 of the conventional arrow rest 12 mounts to the backside 22 of the riser section 14. The cross bar support 24, of the conventional arrow rest 12 adjustably translates across the path of the arrow 26 through the area of the bow 16 called the window region 28. The arrow 26 is comprised of the nock 30 with a groove 32 for engaging the bowstring 34, the fletches or optional vanes 36, the shaftment section 38 and the shaft section 40. The shaft section 40 is displayed resting in the V-groove 42 of the arrow shaft support 44 within the window section 28 of the bow 16. The arrow shaft support 44 is attached to the support-mounting block 46 by the means of two attaching screws 48 while the support-mounting block is thus attached to the conventional arrow rest pivoting unit 50 by means of mounting screws 52. Also adjustably attached to the arrow rest pivoting unit 50 is the steel leaf member 54, adjustable by the means of the pivot adjustment screw 56 and the lock nut 58. The magnet support block 60 attaches to the end of the cross bar support arm 62 by the means of attaching screw 64 aligned by the end and side of the cross bar support 24. The location of the magnet 66 on the magnet support block 60 is such that a gap 68 is adjusted by loosening the lock nut 58, turning the pivot adjustment screw 56 and re-tightening the locknut 58. The size of the gap 68, as can be seen is infinitely adjustable by adjustment of the adjustment screw 56. The aforementioned components all yielding a means to magnetically bias said pivoting unit 50 in a rearward direction at a force sufficient to overcome the bias in the forward direction by the spring 88 or other means to bias the pivoting unit 50 to rotate forward. This force of course is infinitely adjustable by the adjustment of the size of the gap 68 thereby giving the shooter the ability to set extremely accurate points at which the pivoting unit 50 rotates and also the speed at which it rotates.

FIGS. 2 and 3 clarifies the rotational movement of the magnetic drop-away arrow rest conversion kit assembly 10 from being in the cocked position 70, then rotating through the arc 72 about the X-axis of the pivot shaft 74, to the released position 76.

Figure 4:
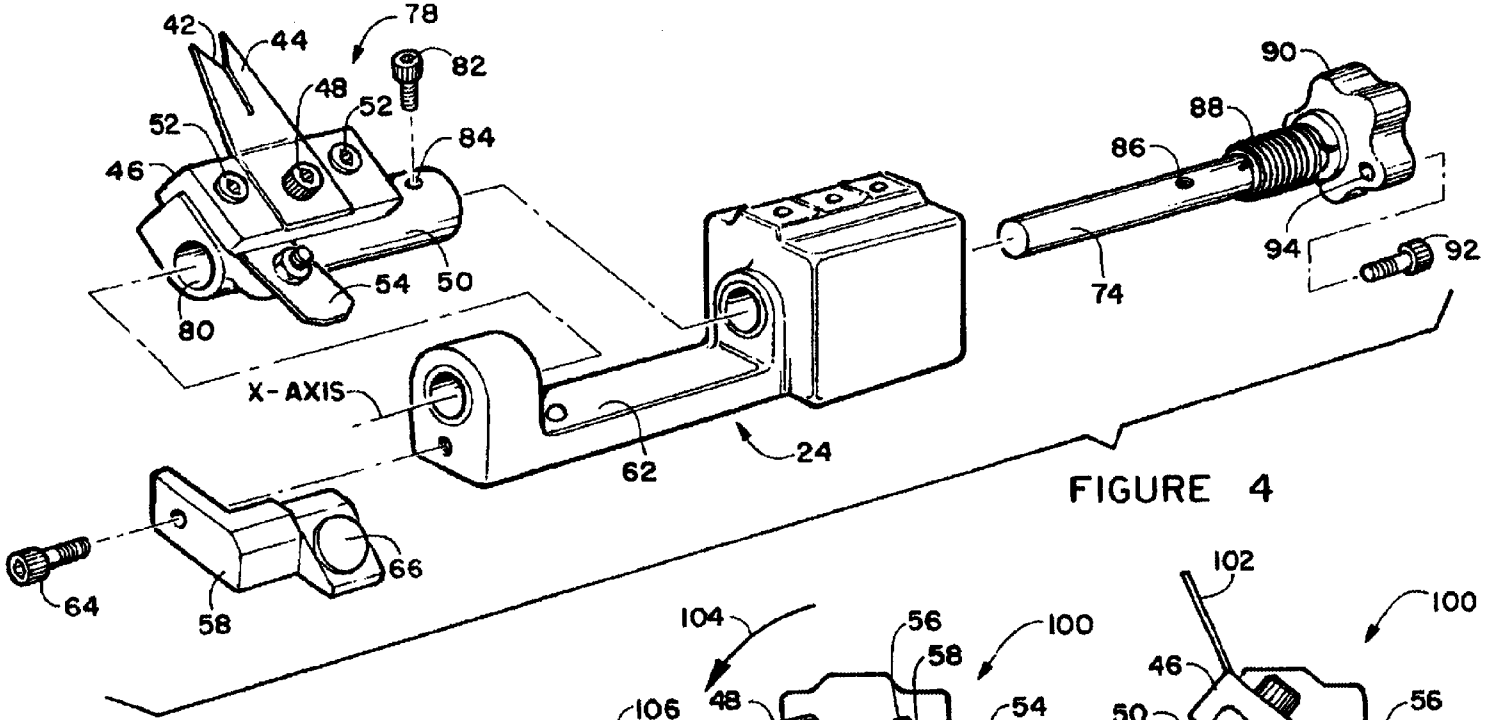
FIG. 4 depicts an exploded view of the magnetic drop-away arrow rest conversion kit attached to a conventional arrow rest.

FIG. 4 further clarifies the components of the magnetic drop-away arrow rest conversion kit 10 and the cross bar support mechanism 62 of the conventional arrow rest 12 by depicting an exploded perspective view with the pivot unit assembly 78 removed to show the orifice 80 that the pivot shaft 74 translates through and the location of the shaft locking screw 82 translating through orifice 84 into threaded orifice 86. A coiled biasing spring 88 is wrapped around the pivot shaft 74 with one end attached thereupon and the other end attached to the biasing spring adjustment knob 90. Pivot shaft 74 rotates freely within the biasing spring adjustment knob 90 so that the pivoting member assembly 78 attached to the pivot shaft 74 by the means of the shaft locking screw 82 may be spring loaded. Tensioning the coil biasing spring 88 is accomplished by rotating the biasing spring adjustment knob 90 and inserting the locking screw 92 through the orifice 94 into one of a plurality of threaded orifices in the distal end of the cross bar support 62.

Figure 5:
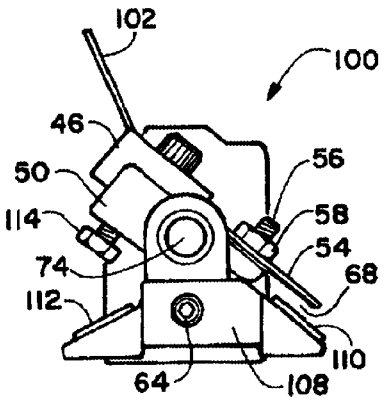
FIG. 5 depicts the alternate embodiment of the magnetic drop-away arrow rest conversion kit with dual magnet attraction, attached to a conventional arrow rest in the cocked position.
Figure 6:
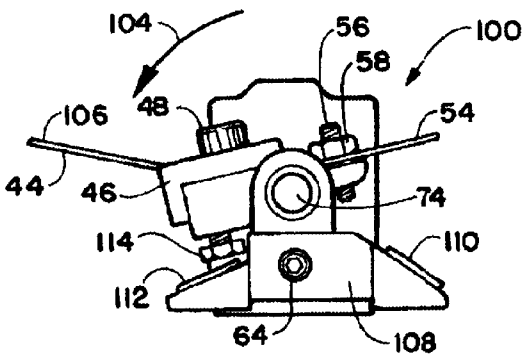
FIG. 6 depicts the alternate embodiment of the magnetic drop-away arrow rest conversion kit with the dual magnet attraction, attached to a conventional arrow rest in the released position.

The alternate embodiment of the magnetic drop-away arrow rest conversion kit assembly features a dual magnet attraction biasing means 100 as displayed in FIGS. 5 and 6. FIG. 5 illustrates the rotational movement from being in the cocked position 102 then rotates through the arc 104 about the X-axis of the pivot shaft 106, to the released position 76. In this embodiment, the magnet support block 108 has a primary magnet 110, reacting with the steel leaf member 54 in a similar way as in the preferred embodiment, maintaining the gap 68. A secondary magnet 112 is located on the opposite side of the magnet support block 108, reacting with the steel head of the secondary stop screw 114. The secondary stop screw 114 will come into full contact with the magnet 112 holding the pivoting assembly 78 down and out of the way of the arrow shaft 40 and the fletches or vanes 36. This secondary magnet 112 and related components provide a means to magnetically bias the pivoting unit 50 in a forward direction replacing the spring 88 for that function.

An additional embodiment of the magnetic drop-away arrow rest conversion kit assembly 10 or the magnetic drop-away arrow rest conversion kit assembly with the dual magnet attraction biasing means 100, will consist of a support-mounting block 46 as an integral part of the pivoting member assembly 78, attaching the arrow shaft support 44 by the means of the mounting screw 48. A locking screw 82 locates the pivoting unit on the pivot shaft 74 incorporating the coil biasing spring 88 and the biasing spring adjustment knob 90. The biasing spring adjustment knob 90 is held in place on the cross bar support 24 by the means of a locking screw 92 on the first embodiment but not required on the second embodiment. The pivoting member assembly 78 also incorporates the steel leaf member 54 attached by the pivot positioning screw 56 and lock nut 58. The end of the cross bar support mechanism will incorporate either the single magnet block 60 of the first embodiment or the dual magnet support block 108 of the second embodiment.

The device and embodiments disclosed herein can be used as an add on kit to existing arrow rests but could also be encompassed into a original equipment device which could alter the castings of the various components to include one or both means for magnetic biasing of the pivoting unit 50 and the adjustments to one or both magnetic biasing means. While the present invention has been described herein with reference to particular embodiments thereof, a latitude of modification, various changes and substitutions are intended in the foregoing disclosure, and it will be appreciated that in some instance some features of the invention will be employed without a corresponding use of other features without departing from the scope of the invention as set forth.

What is claimed is:

1. A magnetic arrow rest biasing apparatus for use in combination with an arrow rest attached adjacent to the handgrip of a bow, said arrow rest having a pivoting unit with an arrow shaft support thereon rotationally engaged with a support member attachable to said bow and a means to bias said pivoting unit to rotate forward, said magnet arrow rest biasing apparatus comprising:

means to magnetically bias said pivoting unit in a rearward direction at a force sufficient to overcome said means to bias said pivoting unit to rotate forward; and said means to magnetically bias said pivoting unit in a rearward direction comprising a magnet and a magnetically attractive component with gap maintained therebetween a most forward biased position of said pivoting unit to a most rearward biased position of said pivoting unit, whereby the forward force of a moving arrow on said shaft support communicated to said pivoting unit will add sufficient forward bias to overcome said bias of said pivoting unit in a rearward direction, thereby rotating said shaft support from contact with any surface of said arrow.

2. The magnetic arrow rest biasing apparatus of claim 1 further comprising:

means to adjust the force of the bias of said pivoting unit in a rearward direction provided by a means to adjust the distance of said gap between said magnet and said magnetically attractive component thereby adjusting the force of said magnetic field upon said magnetically attractive component.

3. The magnetic arrow rest biasing apparatus of claim 2 further comprising:

said means to adjust the distance of said gap between said magnet and said magnetically attractive component is infinitely adjustable.

4. The magnetic arrow rest biasing apparatus of claim 1 wherein said means to magnetically bias said pivoting unit in a rearward direction at a force sufficient to overcome said means to bias said pivoting unit to rotate forward comprises:

a support block, engageable with said support member;

a magnet affixed to the exterior of said support block; and a leaf member comprised of magnetically attractive material attachable to said pivoting unit in a position to be magnetically attracted to a magnetic field generated by said magnet over the distance of said gap when said pivoting unit is operatively engaged with said pivot shaft.

5. The magnetic arrow rest biasing apparatus of claim 4 additionally comprising:

means to adjust the distance of said leaf member from said magnet to obtain a determined gap therebetween.

6. The magnetic arrow rest biasing apparatus of claim 5 wherein said means to adjust the distance of said leaf member from said magnet comprises:

an adjusting screw which rotates said pivoting unit to enlarge or lessen said distance of said leaf member from said magnet.

7. The magnetic arrow rest biasing apparatus of claim 1 wherein said magnet is affixed to said pivoting unit and said leaf member is affixed to said support block.

8. The magnetic arrow rest biasing apparatus of claim 1 wherein said means to bias said pivoting unit to rotate forward comprises:

means to magnetically bias said pivoting unit in a forward direction.

9. The magnetic arrow rest biasing apparatus of claim 8 wherein said means to magnetically bias said pivoting unit in a forward direction comprises:

a second magnet attached to one of said pivoting unit and said support member;

a stop screw, said stop screw mounted to the other of said pivoting unit and said support member opposite the mounting of said second magnet;

said stop screw having a head portion contacting said second magnet when said pivoting unit is biased to a forward position; and said head portion spaced apart from said second magnet when said pivoting unit is in said most rearward biased position, whereby the forward force of a moving arrow on said shaft support communicated to said pivoting unit will add sufficient forward bias to overcome said bias of said pivoting unit in a rearward direction, thereby rotating said head portion back to contact with said second magnet and said shaft support from contact with any surface of said arrow.

10. An arrow rest for attachment adjacent to the handgrip of a bow and support of an arrow prior to a shot, comprising:

a support member having an axial passage therethrough;

a pivot shaft rotationally engaged in said axial passage;

a pivoting unit having an arrow shaft support thereon engaged for rotation with said support member;

means to bias said pivoting unit to rotate forward;

means to magnetically bias said pivoting unit in a rearward direction at a force sufficient to overcome said means to bias said pivoting unit to rotate forward when said pivoting unit is rotated rearward past a predetermined point;

said means to magnetically bias said pivoting unit in a rearward direction comprising a magnet and a magnetically attractive component with a gap maintained therebetween at a most rearward biased position of said pivoting unit; and whereby the forward force of a moving arrow on said shaft support communicated to said pivoting unit will add sufficient forward bias to overcome said bias of said pivoting unit in a rearward direction, thereby rotating said shaft support from contact with any surface of said arrow.

11. An arrow rest of claim 10 further comprising:

means to adjust the force of the bias of said pivoting unit in a rearward direction provided by a means to adjust the distance of said gap between said magnet and said magnetically attractive component at said most rearward biased position of said pivoting unit thereby adjusting the force of said magnetic field upon said magnetically attractive component.

12. The arrow rest of claim 10 further comprising:

said distance of said gap between said magnet and said magnetically attractive component at said most rearward biased position of said pivoting unit is infinitely adjustable.

13. The arrow rest of claim 10 further comprising:

means to bias said pivoting unit to rotate forward is a spring attached to said pivot shaft.

14. The arrow rest of claim 10, further comprising:

means to bias said pivoting unit to rotate forward comprises:

means to magnetically bias said pivoting unit in a forward direction.

15. The arrow rest of claim 14 wherein said means to magnetically bias said pivoting unit in a forward direction comprises:

a second magnet attached to one of said pivoting unit and said support member;

a stop screw, said stop screw mounted to the other of said pivoting unit and said support member opposite the mounting of said second magnet;

said stop screw having a head portion contacting said second magnet when said pivoting unit is biased to a forward position; and said head portion detached from said second magnet when said pivoting unit is in said most rearward biased position, whereby the forward force of a moving arrow on said shaft support communicated to said pivoting unit will add sufficient forward bias to overcome said bias of said pivoting unit in a rearward direction, thereby rotating said head portion back to contact with said second magnet and said shaft support from contact with any surface of said arrow.

* * * * *